US010829937B2

(12) United States Patent
Whitridge, Jr. et al.

(10) Patent No.: US 10,829,937 B2
(45) Date of Patent: Nov. 10, 2020

(54) ROOFING SYSTEM AND METHOD

(71) Applicant: Millennium Slate, LLC, Middle Granville, NY (US)

(72) Inventors: Frederick Wallingford Whitridge, Jr., Stanfordville, NY (US); Phil C. Prehoda, Middle Granville, NY (US); Thomas J. Collard, West Pawlet, NY (US)

(73) Assignee: Millennium Slate, LLC, Middle Granville, NY (US)

( * ) Notice: Subject to any disclaimer, the term of this patent is extended or adjusted under 35 U.S.C. 154(b) by 0 days.

(21) Appl. No.: 16/000,347

(22) Filed: Jun. 5, 2018

(65) Prior Publication Data

US 2018/0347195 A1 Dec. 6, 2018

Related U.S. Application Data

(60) Provisional application No. 62/515,162, filed on Jun. 5, 2017.

(51) Int. Cl.
*E04D 1/34* (2006.01)
*E04D 1/12* (2006.01)
(Continued)

(52) U.S. Cl.
CPC ..... *E04D 1/34* (2013.01); *E04D 1/12* (2013.01); *E04D 1/14* (2013.01); *E04D 1/2918* (2019.08);
(Continued)

(58) Field of Classification Search
CPC .... E04D 2001/3429; E04D 2001/3447; E04D 2001/3455; E04D 2001/3438; E04D 2001/3485; E04D 2001/3414
See application file for complete search history.

(56) References Cited

U.S. PATENT DOCUMENTS 623,988 A * 5/1899 Contant ..... E04D 13/10 52/26
676,579 A * 6/1901 Esselen ..... E04D 13/10 52/26
(Continued)

FOREIGN PATENT DOCUMENTS

DE 4100902 A * 8/1991
DE 19926344 C1 * 3/2001
(Continued)

OTHER PUBLICATIONS

Derwent Abstract of German Patent: DE 29819035 U1 (Year: 1999).*
Derwent Abstract of KR 1944212 B1 (Year: 2019).*

*Primary Examiner* — Joshua J Michener
*Assistant Examiner* — Charissa Ahmad
(74) *Attorney, Agent, or Firm* — Bulkley, Richardson and Gelinas LLP; Mary R. Bonzagni, Esq.

(57) ABSTRACT

A system and method of roofing. The present invention includes a fabric sheet having an upper surface and a lower surface. The upper surface includes one of a hook and loop fastener and the lower surface is configured to be attached to a roof decking. The present invention further includes a plurality of tiles each having an upper edge, a lower edge, a top surface, and a bottom surface. The other of the hook and loop fastener is attached to the bottom surface. The plurality of tiles are releasably attached to the upper surface of the fabric sheet via the hook and loop fasteners.

13 Claims, 4 Drawing Sheets

(51) Int. Cl.
*E04D 1/00* (2006.01)
*E04D 1/14* (2006.01)
*E04D 12/00* (2006.01)

(52) U.S. Cl.
CPC .... *E04D 12/002* (2013.01); *E04D 2001/3408* (2013.01); *E04D 2001/3429* (2013.01); *E04D 2001/3435* (2013.01); *E04D 2001/3438* (2013.01); *E04D 2001/3447* (2013.01); *E04D 2001/3455* (2013.01); *E04D 2001/3458* (2013.01); *E04D 2001/3473* (2013.01); *E04D 2001/3494* (2013.01)

(56) References Cited

U.S. PATENT DOCUMENTS 1,107,568 A * 8/1914 Bamberger et al. .... E04D 3/362 52/520
1,462,212 A * 7/1923 Percsenyi ..... E04D 1/18 52/278
1,467,510 A * 9/1923 Smith, Jr. ..... E04D 1/26 52/420
1,590,744 A * 6/1926 Hatch ..... E04D 1/16 52/520
1,597,135 A * 8/1926 Wittenberg ..... E04D 1/26 52/559
1,619,600 A * 3/1927 Cumfer ..... E04D 1/26 52/529
1,661,562 A * 3/1928 Conway ..... E04D 1/22 52/394
1,963,583 A * 6/1934 Jenkins ..... E04D 3/363 52/520
2,149,818 A * 3/1939 North ..... E04D 1/28 52/409
2,210,209 A * 8/1940 Kirschbraun ..... E04D 1/26 52/420
2,250,918 A * 7/1941 Roos ..... D21J 1/00 118/110
2,292,984 A * 8/1942 Alvarez, Jr. ..... E04F 13/0803 52/409
2,300,488 A * 11/1942 Cuno ..... E04D 1/26 52/420
2,535,620 A * 12/1950 Alvarez, Jr. ..... E04F 13/0864 52/472
3,418,777 A * 12/1968 Gillis ..... E04D 12/00 52/520
3,703,062 A * 11/1972 McKinney ..... E04D 3/36 52/545
3,913,294 A * 10/1975 Freiborg ..... E04D 1/30 52/518
3,945,166 A * 3/1976 Hosoda ..... E04D 3/30 52/520
3,999,348 A * 12/1976 Hicks ..... E04D 3/30 52/544
4,426,823 A * 1/1984 Kobe ..... E04D 1/045 52/748.1
4,489,115 A * 12/1984 Layman ..... E01C 13/08 156/258
4,499,700 A * 2/1985 Gustafsson ..... E04D 3/365 52/478
4,649,069 A * 3/1987 Tone ..... A47G 27/0293 428/45
4,668,315 A * 5/1987 Brady ..... E04D 11/02 156/278
4,974,384 A * 12/1990 Pacione ..... E04B 1/168 52/241
5,505,788 A * 4/1996 Dinwoodie ..... F24S 25/40 136/246
5,617,690 A * 4/1997 Gibbs ..... E04D 1/34 52/518
5,642,596 A * 7/1997 Waddington ..... E04D 1/34 52/546
5,737,881 A * 4/1998 Stocksieker ..... E04D 1/18 52/460
5,794,396 A * 8/1998 Gibbs ..... E04D 1/16 52/518
5,916,103 A * 6/1999 Roberts ..... E04D 1/26 52/105
5,950,387 A * 9/1999 Stahl ..... E04D 1/26 52/555
6,298,624 B1 * 10/2001 Pacione ..... A47G 27/025 52/311.2
6,336,304 B1 * 1/2002 Mimura ..... E04D 1/365 52/748.1
6,534,703 B2 * 3/2003 Dinwoodie ..... H02S 20/23 136/251
7,219,476 B2 5/2007 Akins et al.
7,578,108 B2 * 8/2009 Swanson ..... E04D 1/26 156/71
8,256,185 B2 * 9/2012 Kirkey ..... E04D 1/20 52/518
8,276,329 B2 * 10/2012 Lenox ..... E04D 13/172 52/173.3
8,297,020 B1 * 10/2012 Swanson ..... E04D 1/26 156/297
9,234,352 B2 * 1/2016 Olson ..... E04D 5/148
9,788,674 B2 * 10/2017 Pacione ..... A47G 27/0293
10,233,646 B2 * 3/2019 McGraw ..... E04D 5/142
10,358,824 B2 * 7/2019 Aschenbeck ..... E04D 1/36
2001/0042350 A1 * 11/2001 Pacione ..... A47G 27/0293 52/506.1
2003/0070391 A1 * 4/2003 Tachauer ..... A44B 18/0049 52/745.21
2004/0000334 A1 * 1/2004 Ressler ..... H02S 20/23 136/251
2004/0055240 A1 * 3/2004 Kiik ..... A47G 27/0468 52/545
2005/0252141 A1 * 11/2005 Kerkar ..... E04D 1/26 52/551
2006/0154017 A1 * 7/2006 Shepard ..... A44B 18/0049 428/99
2006/0191218 A1 * 8/2006 Pacione ..... A47G 27/0243 52/234
2007/0266660 A1 * 11/2007 Davies ..... E04D 5/12 52/309.1
2009/0220720 A1 * 9/2009 Mohseen ..... E04D 1/26 428/41.7
2010/0059104 A1 * 3/2010 Geary ..... E04D 11/00 136/251
2012/0266559 A1 * 10/2012 Thies, III ..... E04D 1/26 52/747.1
2013/0025225 A1 * 1/2013 Vermilion ..... E04D 1/26 52/518
2013/0160388 A1 * 6/2013 Williams ..... E04D 1/34 52/551
2015/0089895 A1 * 4/2015 Leitch ..... E04D 1/28 52/518
2016/0340903 A1 * 11/2016 Folkersen ..... E04D 1/26
2017/0145271 A1 * 5/2017 Loftus ..... C09J 195/00
2017/0306632 A1 * 10/2017 Wood ..... E04F 13/0882

FOREIGN PATENT DOCUMENTS

FR 2483493 A * 12/1981 ..... E04D 13/004
GB 2145131 A * 3/1985 ..... E04D 13/004
GB 2341618 A * 3/2000
WO WO-8102437 A1 * 9/1981 ..... E04D 1/265
WO WO-9836139 A1 * 8/1998 ..... E04D 1/26

* cited by examiner

ROOFING SYSTEM AND METHOD

CROSS-REFERENCE TO RELATED APPLICATION

This application claims the benefit of priority of U.S. provisional application No. 62/515,162, filed Jun. 5, 2017, the contents of which are herein incorporated by reference.

BACKGROUND OF THE INVENTION

The present invention relates to roofing and, more particularly, to a system and method of roofing utilizing a hook and loop fastener.

Existing systems for affixing roofing slate to buildings are expensive in both materials and labor. The current systems include nailing or screwing slate to the roof, using cumbersome hook and rail systems, or using a clamping type track system. Each of these traditional systems are expensive in terms of material and require a considerable amount of labor.

Additionally, nailed and screwed applications can be "over nailed" or "under nailed" referring to the height of the head of the fastener in relation to the face of the slate. Under nailed slate, with heads that protrude above the face of the slate, may break the pieces of slate which overlap them. Over nailed slate, with a head of the nail driven down into the countersink area on the slate, risks breakage. Hooked systems can be troublesome if the nailing eye of the hook is missed. Hooks can typically only be applied in a rigidly preset pattern and do not adapt easily to varying field conditions or design changes which may become desirable during installations. Tracked and clamping systems are also very rigid in terms of layout and don't allow variations in the natural material.

As can be seen, there is a need for an improved system and method of roofing.

SUMMARY OF THE INVENTION

In one aspect of the present invention, a system of roofing comprises: a fabric sheet comprising an upper surface and a lower surface, wherein the upper surface comprises one of a hook and loop fastener and the lower surface is configured to be attached to a roof decking; and a plurality of tiles each comprising an upper edge, a lower edge, a top surface, and a bottom surface, wherein the other of the hook and loop fastener is attached to the bottom surface.

In another aspect of the present invention, a method of installing tiles on a roof comprises: attaching a lower surface of a fabric sheet to a roof decking, wherein the fabric sheet comprises an upper surface comprising one of a hook and loop fastener; providing a plurality of tiles each comprising an upper edge, a lower edge, a top surface, and a bottom surface, wherein the other of the hook and loop fastener is attached to the bottom surface; and releasably securing the plurality of tiles to the upper surface of the fabric sheet via the hook and loop fasteners.

These and other features, aspects and advantages of the present invention will become better understood with reference to the following drawings, description and claims.

DETAILED DESCRIPTION OF THE INVENTION

Figure 1:
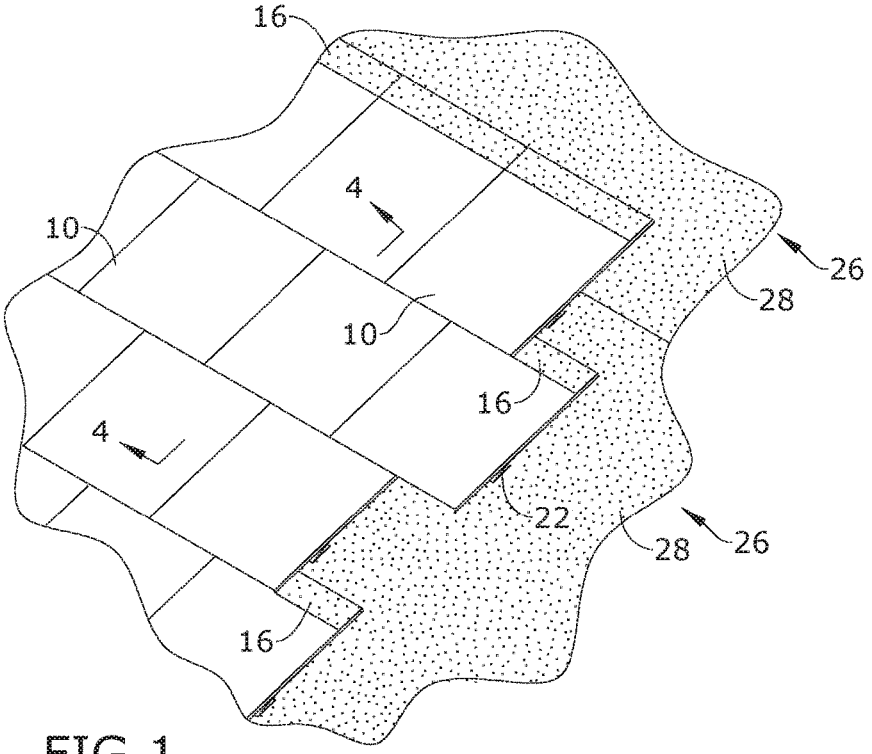
FIG. 1 is a perspective view of a partial installation of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a system and method of roofing. A roll of self-adhesive hook and loop fabric is rolled out on a bare roof. This membrane is both a moisture barrier and serves as one half of the mechanical fastening hook and loop system. Tapes or patches of hook and loop fabric are adhered to natural stone roofing slate. Individual slate tiles, with attached hook and loop tape or fabric, may then be applied to a roof where the loop fabric has been applied. Advantageously, the detachability of this hook and loop method allows changes to be easily made while installation is underway.

The hook and loop system and method of the present invention removes the variable quality and expensive field labor of a traditional installation methods. Individual tiles may be easily pressed together in patterns which may be dictated by field conditions. Beneficially, changing an individual tile because of improper color or placement is easily solved by the detachable and replaceable nature of the hook and loop fastening system.

In one embodiment, the current invention includes the following steps of use. The front and back faces of roofing slate tiles are thoroughly cleaned via water, brush, and detergent or solvent as necessary to allow gluing or self-stick of the hook fabric or tape. The roof deck is thoroughly cleaned with water, brush, and detergent or solvent as necessary to allow proper adhesion of the self-stick or glued loop fabric. A primer may be applied if required by the adhesive system. Two pieces of hook and loop tape may be applied, using a self-stick adhesive or glue, horizontally across the top and bottom of the back face of the individual slate tiles. One piece of hook and loop tape may be applied, via self-stick adhesive or glue, horizontally across the top of the front face of the individual slate tile. Patterned slate, for example with diamond or rounded butts or lower edges, may require different orientation and coverage of hook and loop material. Hip, ridge, valley, and starter slate requires different hook and loop layouts. For shipment, slates with tapes or fabric attached are stacked vertically on pallets with hook facing hook, and loop facing loop. For wind and snow prone areas, or for certain components of a roof such as the hip and ridge, both sides of the hook and loop system may be treated with a two part or thermoset adhesive.

For thicker slates with the larger airspace between the slates and the roof deck, a Z-shaped metal spring may be used. The bottom face of the Z-shaped metal spring is adhered to the back face of the slate. A hook and looped tape is adhered to the exposed top face of the Z-shaped metal spring. The expanding spring quality of the metal presses the hook and loop fabrics together when the slate tile is applied to the roof.

Individual pieces of slate are pressed onto the hook and loop fabric, which has been previously applied to the roof. Slates are overlapped by about two inches at the top and bottom. Thus, the hook and loop fabric tape applied to the bottom of the rear face of a piece of slate connects with the hook and loop fabric tape applied across the top of the front face of another slate. In wind prone areas, it may be desirable to pre-treat the rolled fabric and the hook and loop tapes with a two part or thermoset adhesive. Until the adhesive is tacky or set up, the detachable, re-attachable nature of the hook and loop system remains available for changes during installation.

In one embodiment, a traditionally laid slate roof is triple overlapped with a three-inch head lap. Thus a 12" long piece of traditionally laid slate would have 4.5" exposure, 4.5" of triple lapped unexposed slate, and 3" of head lap. With this system, only a single 2" overlap is needed since the loop fabric on the deck is providing a water proof membrane. Beneficially, this results in about 45% of the weight versus traditionally applied slate. Further, there are additional savings in time, money, and weight is the absence of nails. Carefully driving these nails far enough down so they are not under nailed (head of nail sticking up from face of slate) or over nailed (nail head driven down into countersink on face of slate) results in potentially breaking the slate during installation. Typically, an accomplished traditional slate roofer can only apply 3-4 square in a day, due to the time and care involved in nailing. The current roofing system, with individual pieces of slate just pressed together with the hook and loop system doing the attachment, is estimated to be applied 4 to 5 times faster than traditional nailed slate.

The hook and loop system takes out much of the variable quality and expensive field labor of a traditional installation method. Individual tiles may be easily pressed together in patterns which may be dictated by field conditions. Changing an individual tile because of improper color or placement is easily solved by the detachable and replaceable nature of the hook and loop fastening system.

Figure 2:
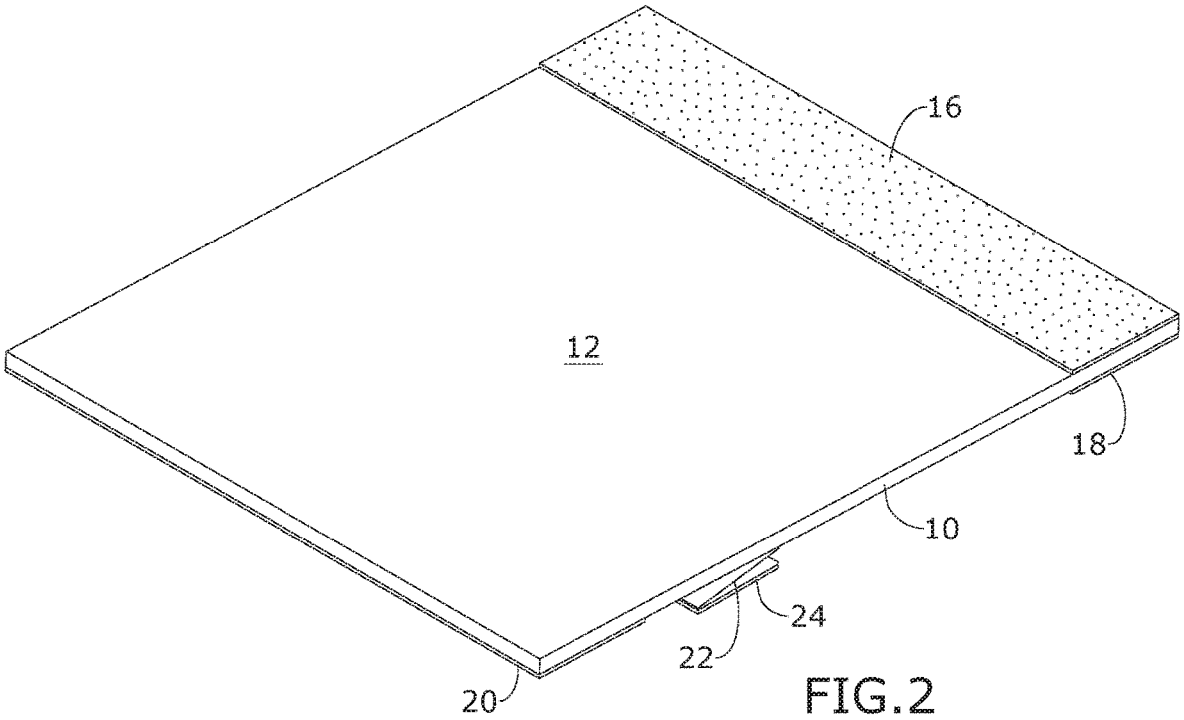
FIG. 2 is a top perspective view of a tile of an embodiment of the present invention.
Figure 3:
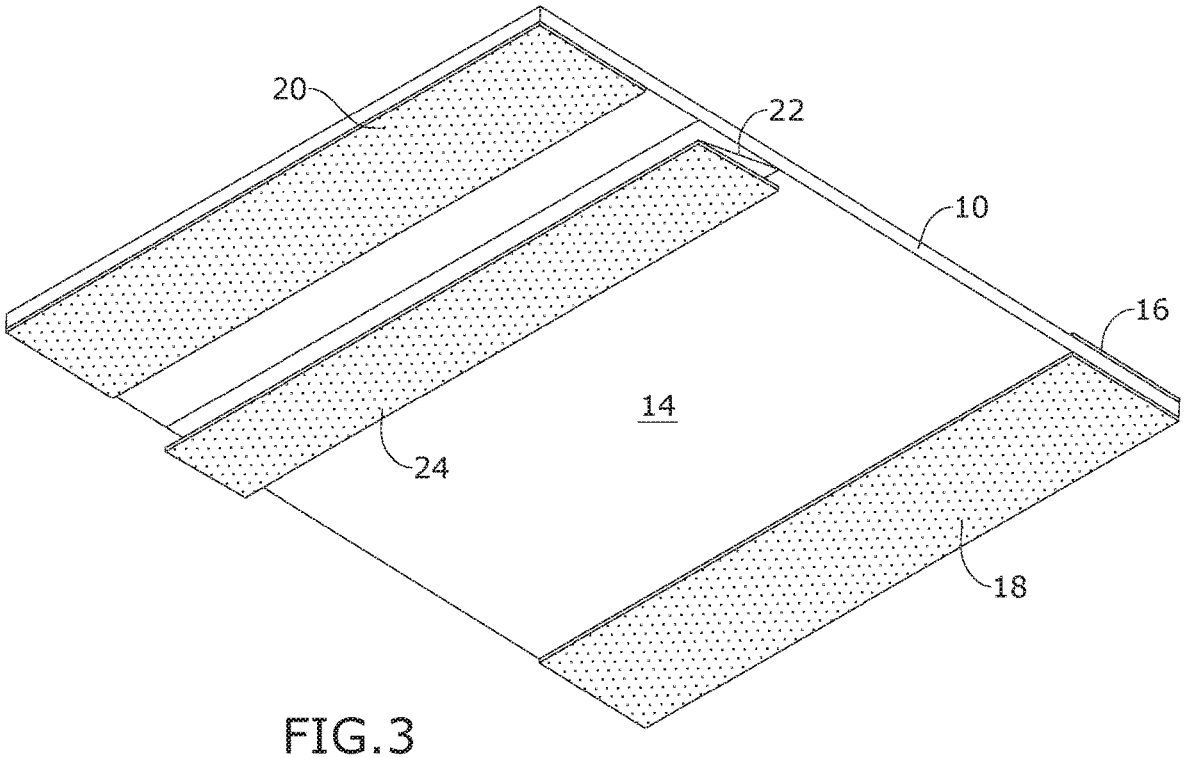
FIG. 3 is a bottom perspective view of a tile of an embodiment of the present invention.
Figure 4:
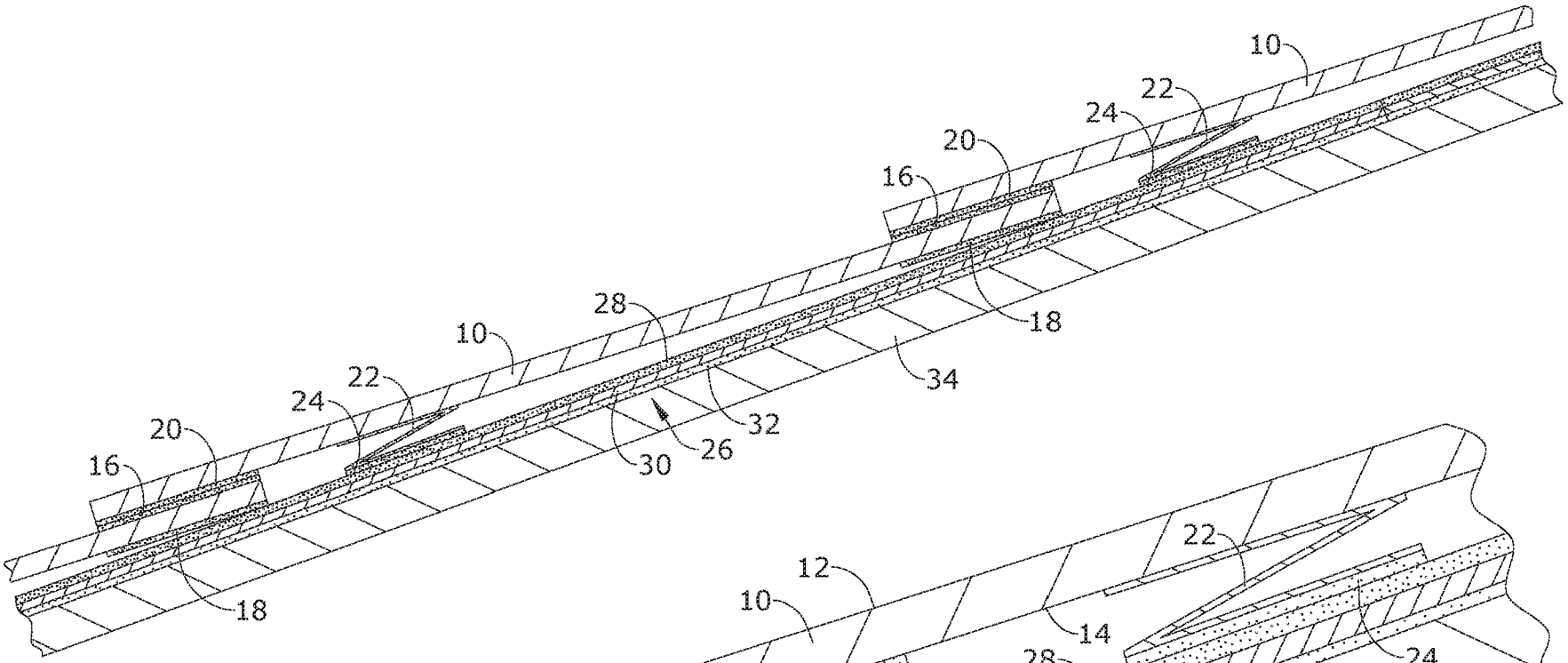
FIG. 4 is a section view of the present invention taken along line 4-4 in FIG. 1.
Figure 5:
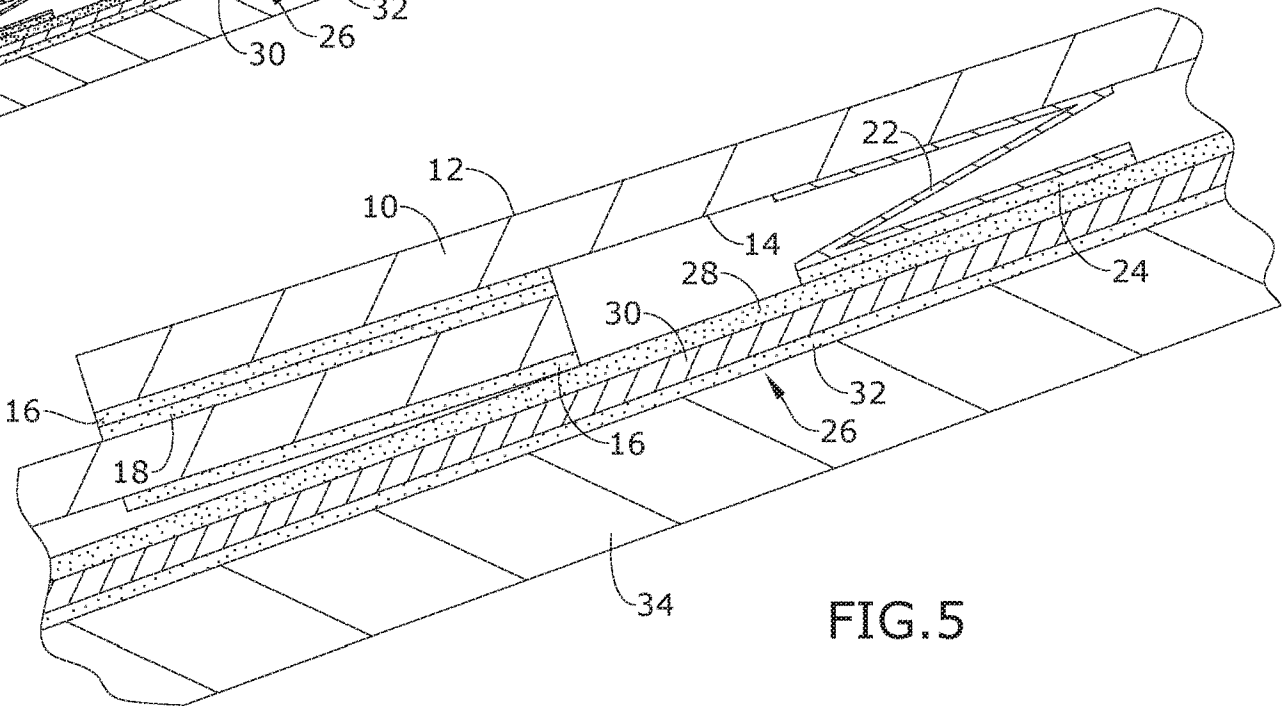
FIG. 5 is a detail section view of an embodiment of the present invention.
Figure 6:
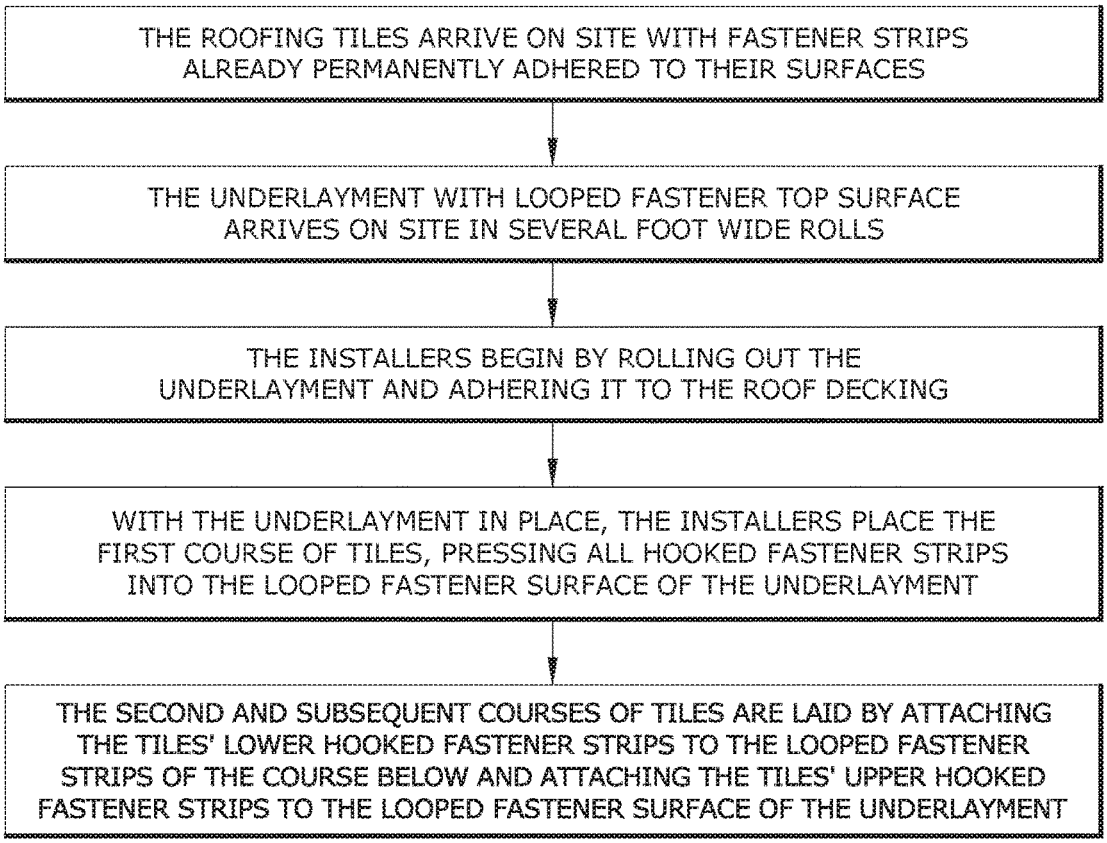
FIG. 6 is a flow chart of a method of installing tiles of an embodiment of the present invention.
Figure 7:
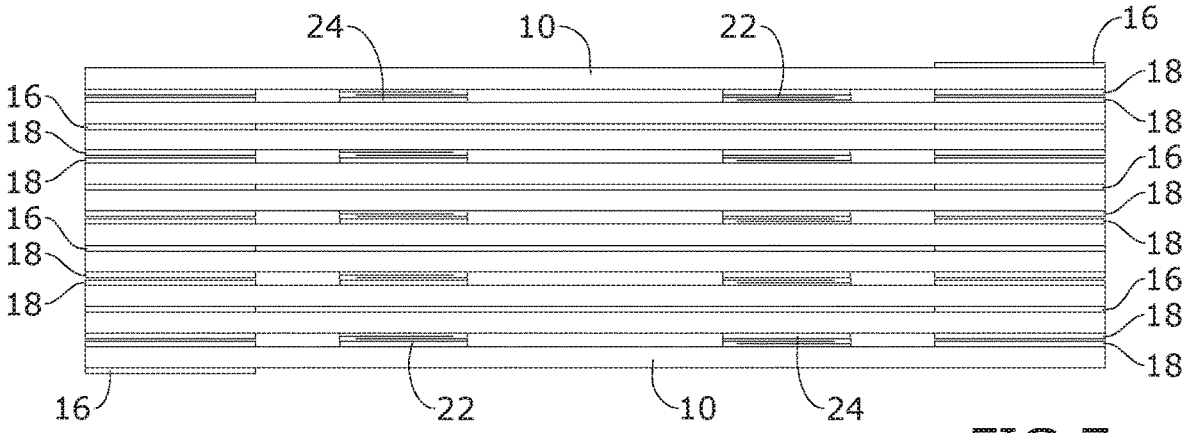
FIG. 7 is a side view of tiles stacked for storage and shipping.

Referring to FIGS. 1 through 7, the present invention includes a system and method of roofing. The present invention includes a fabric sheet 30 having an upper surface and a lower surface. The upper surface includes one of a hook and loop fastener 16, 28 and the lower surface is configured to be attached to a roof decking 34. The present invention further includes a plurality of tiles 10 each having an upper edge, a lower edge, a top surface 12, and a bottom surface 14. The other of the hook and loop fastener 18, 20 is attached to the bottom surface 14 of each of the tiles 10.

The one of the hook and loop fastener 16, 28 may be either the hook or the loop portion of the hook and loop fastener. The other of the hook and loop fastener 18, 20 may be either the hook or loop portion of the hook and loop fastener as long as the other of the hook and loop fastener 18, 20 releasably connects to the one of the hook and loop fastener 16, 28. For example, the one of the hook and loop fastener 16, 28 is looped fastener and the other of the hook and loop fastener 18, 20 is hook fastener or vis versa.

The fabric sheet 30 of the present invention is a water impermeable material including the upper surface and the lower surface. An adhesive layer 32 may be disposed on the lower surface and the one of the hook and loop fastener 28 is disposed on the upper surface. In such embodiments, the adhesive layer 32 secures the fabric sheet 30 to the roof decking 34. In one embodiment, the fabric sheet 30 may include printed or etched lines in a grid pattern to provide a reference for orientation of the individual slate tiles 10 pressed down upon it.

Each of the plurality of tiles 10 may further include a first strip 18 including the hook and loop fastener attached to the bottom surface 14 at the upper edge, a second strip 20 including the hook and loop fastener attached to the bottom surface 14 at the lower edge, and a third strip 16 having the hook and loop fastener attached to the top surface 14 at the upper edge. In such embodiments, the tiles 10 are releasably secured to the upper surface of the fabric sheet 30 by: releasably securing the first strips 18 of the tiles 10 to the upper surface of the fabric sheet 30; overlapping the tiles 10 with one another; and releasably securing the second strips 20 of the tiles to the third strips 16 of other tiles.

Each of the plurality of tiles 10 may further include a support 22 disposed in between the upper edge and the lower edge and extending from the bottom surface 14 of the tiles 10. The support 22 includes a Z-spring having an upper arm adhered to the bottom surface of the tile 10, and a lower arm. The lower arm includes a fourth strip 24 of hook and loop fastener that releasably connects with the hook and loop fastener 28 of the fabric sheet 30.

It should be understood, of course, that the foregoing relates to exemplary embodiments of the invention and that modifications may be made without departing from the spirit and scope of the invention as set forth in the following claims.

What is claimed is:

1. A system of roofing comprising:

a sheet comprising an upper surface and a lower surface, wherein the upper surface comprises one of a hook and loop fastener and the lower surface is configured to be attached to a roof decking; and a plurality of tiles each comprising an uppermost edge, a lowermost edge, a top surface, and a bottom surface, wherein the other of the hook and loop fastener is attached to and covers less than the entire bottom surface, wherein each of the plurality of tiles further comprise a first strip comprising the other of the hook and loop fastener attached to the bottom surface at or near the uppermost edge and a second strip comprising the other of the hook and loop fastener attached to the bottom surface at or near the lowermost edge, wherein each of the plurality of tiles further comprise a third strip comprising the one of the hook and loop fastener attached to the top surface at or near the uppermost edge, and wherein, the first, second and third strips extend substantially along the entire width of each tile, wherein each of the plurality of tiles further comprises a Z-spring disposed in between an upper edge and a lower edge and extending from the bottom surface, wherein the Z-spring comprises an upper arm adhered to the bottom surface of the tile, and a lower arm comprising the other of the hook and loop fastener, and wherein the Z-spring presses the hook and loop fastener of the Z-spring and the hook and loop fastener of the sheet together.

2. The system of claim 1, wherein the sheet is a water impermeable material comprising the upper surface and the lower surface, wherein an adhesive configured to be disposed on the lower surface and the one of the hook and loop fastener is disposed on the upper surface.

3. The system of roofing of claim 1, wherein each tile is a natural stone tile.

4. A method of installing tiles on a roof comprising:

attaching a lower surface of a sheet to a roof decking, wherein the sheet comprises an upper surface comprising one of a hook and loop fastener;

providing a plurality of tiles each comprising an uppermost edge, a lowermost edge, a top surface, and a bottom surface, wherein the other of the hook and loop fastener is attached to and covers less than the entire bottom surface; and releasably securing the plurality of tiles to the upper surface of the sheet via the hook and loop fasteners, wherein each of the plurality of tiles further comprise a first strip comprising the other of the hook and loop fastener attached to the bottom surface at or near the uppermost edge, a second strip comprising the other of the hook and loop fastener attached to the bottom surface at or near the lowermost edge, and a third strip comprising the one of the hook and loop fastener attached to the top surface at or near the uppermost edge, and wherein, the first, second and third strips extend substantially along the entire width of each tile, wherein each of the plurality of tiles further comprises a Z-spring disposed in between an upper edge and a lower edge and extending from the bottom surface, wherein the Z-spring comprises an upper arm adhered to the bottom surface of the tile, and a lower arm comprising the other of the hook and loop fastener, and wherein the Z-spring presses the hook and loop fastener of the Z-spring and the hook and loop fastener of the sheet together.

5. The method of claim 4, wherein the sheet is a water impermeable material comprising the upper surface and the lower surface, wherein an adhesive configured to be disposed on the lower surface and the one of the hook and loop fastener is disposed on the upper surface.

6. The method of claim 5, wherein the step of attaching the lower surface of the sheet to the roofing deck comprises adhering the lower surface of the sheet to the roofing deck.

7. The method of claim 4, wherein releasably securing the plurality of tiles to the upper surface of the sheet via the hook and loop fasteners comprises the steps of:

releasably securing the first strip of the tiles to the upper surface of the sheet; and overlapping the tiles with one another; and releasably securing the second strips of the tiles to the third strips of other tiles.

8. The method of installing tiles on a roof of claim 7, wherein each tile is a natural stone tile.

9. A system of roofing comprising:

a sheet comprising an upper surface and a lower surface, wherein the upper surface comprises one of a hook and loop fastener and the lower surface is configured to be attached to a roof decking; and a plurality of natural stone tiles each comprising an upper edge, a lower edge, a top surface and a bottom surface, wherein the other of the hook and loop fastener is attached to the bottom surface, wherein each of the plurality of tiles further comprises a Z-spring disposed in between an upper edge and a lower edge and extending from the bottom surface, wherein the Z-spring comprises an upper arm adhered to the bottom surface of the tile, and a lower arm comprising the other of the hook and loop fastener, and wherein the Z-spring presses the hook and loop fastener of the Z-spring and the hook and loop fastener of the sheet together.

10. The system of roofing of claim 9, wherein the natural stone tiles are slate tiles.

11. A method of installing tiles on a roof comprising:

attaching a lower surface of a sheet to a roof decking, wherein the sheet comprises an upper surface comprising one of a hook and loop fastener;

providing a plurality of natural stone tiles each comprising a top surface and a bottom surface, wherein the other of the hook and loop fastener is attached to the bottom surface; and releasably securing the plurality of natural stone tiles to the upper surface of the sheet via the hook and loop fasteners, wherein each of the plurality of tiles further comprises a Z-spring disposed in between an upper edge and a lower edge and extending from the bottom surface, wherein the Z-spring comprises an upper arm adhered to the bottom surface of the tile and a lower arm comprising the other of the hook and loop fastener, and wherein the Z-spring presses the hook and loop fastener of the Z-spring and the hook and loop fastener of the sheet together.

12. A system of roofing comprising:

a sheet comprising an upper surface and a lower surface, wherein the upper surface comprises one of a hook and loop fastener and the lower surface is configured to be attached to a roof decking; and a plurality of tiles each comprising a top surface and a bottom surface, wherein the other of the hook and loop fastener is attached to the bottom surface, wherein each of the plurality of tiles further comprises a Z-spring disposed in between an upper edge and a lower edge and extending from the bottom surface, wherein the Z-spring comprises an upper arm adhered to the bottom surface of the tile, and a lower arm comprising the other of the hook and loop fastener, and wherein the Z-spring presses the hook and loop fastener of the Z-spring and the hook and loop fastener of the sheet together.

13. A method of installing tiles on a roof comprising:

attaching a lower surface of a sheet to a roof decking, wherein the sheet comprises an upper surface comprising one of a hook and loop fastener;

providing a plurality of tiles each comprising a top surface and a bottom surface, wherein the other of the hook and loop fastener is attached to the bottom surface; and releasably securing the plurality of tiles to the upper surface of the sheet via the hook and loop fasteners, wherein each of the plurality of tiles further comprises a Z-spring disposed in between an upper edge and a lower edge and extending from the bottom surface, wherein the Z-spring comprises an upper arm adhered to the bottom surface of the tile, and a lower arm comprising the other of the hook and loop fastener, and wherein the Z-spring presses the hook and loop fastener of the Z-spring and the hook and loop fastener of the sheet together.

* * * * *